US006382525B1

(12) United States Patent
Santiesteban et al.

(10) Patent No.: US 6,382,525 B1
(45) Date of Patent: May 7, 2002

(54) SPRINKLER HEAD WITH SHIELDING WEIGHTED COLLAR

(75) Inventors: Theodore G. Santiesteban, Ocoee, FL (US); Jeffery S. Mitchell, Lubbock, TX (US)

(73) Assignee: Senninger Irrigation, Inc., Orlando, FL (US)

( * ) Notice: Subject to any disclaimer, the term of this patent is extended or adjusted under 35 U.S.C. 154(b) by 0 days.

(21) Appl. No.: 09/792,724

(22) Filed: Feb. 23, 2001

(51) Int. Cl.[7] ..... B05B 3/02

(52) U.S. Cl. ..... 239/222.11; 239/288; 239/390; 239/505; 239/523; 239/524; 239/588; 239/600

(58) Field of Search ..... 239/214, 222.11, 239/222.17, 222.21, 390, 391, 288, 498, 505, 523, 524, 588, 521, 600

(56) References Cited

U.S. PATENT DOCUMENTS

| | | | | |
|---|---|---|---|---|
| 4,356,972 A | | 11/1982 | Vikre | |
| 5,333,796 A | * | 8/1994 | Purtell et al. | 239/588 |
| 5,381,960 A | | 1/1995 | Sullivan et al. | |
| 5,439,174 A | * | 8/1995 | Sweet | 239/222.17 |
| 5,671,885 A | * | 9/1997 | Davisson | 239/222.17 |
| 5,950,927 A | * | 9/1999 | Elliott et al. | 239/222.21 |
| 6,176,440 B1 | * | 1/2001 | Elliott | 239/222.21 |

* cited by examiner

*Primary Examiner*—Steven J. Ganey
(74) *Attorney, Agent, or Firm*—William M. Hobby, III

(57) ABSTRACT

A sprinkler head especially adapted for use in irrigation systems, such as center pivot irrigation systems, in which a long water conduit is connected at one end to a source of water under pressure. The sprinkler head has a body attached to a water supply and has a water inlet and a nozzle for directing water therefrom. The sprinkler head body has an upper body portion having a first interlocking member thereon and a lower body portion having a plurality of arms extending therefrom. A water deflecting head is removably attached to the sprinkler head body lower body portion below the plurality of downwardly extending arms to deflect water being emitted from a nozzle thereagainst. A weighted collar has a bore therethrough and has a second interlocking member thereon. The weighted collar has a weight greater than one quarter pound and is removably attached to the sprinkler head body upper body portion with a second interlocking member engaging the sprinkler upper body interlocking member. The weighted collar has a deflection surface positioned to deflect a portion of the water being deflected by the water deflection head. It also acts to shield the sprinkler head body from damage while adding weight to the sprinkler head for damping vibrations and wind resistance.

8 Claims, 2 Drawing Sheets

SPRINKLER HEAD WITH SHIELDING WEIGHTED COLLAR

BACKGROUND OF THE INVENTION

The present invention relates to sprinkler heads and especially to a sprinkler head for use in irrigation systems.

It has become common practice to use center pivot and similar irrigation systems in the irrigation of large fields and these typically comprise a long water conduit which is pivotally connected at one end to a source of water under pressure. The conduit arm is carried in an elevated position by a plurality of spaced wheels or wheel towers which are powered by hydraulic, pneumatic, or electric motors to rotatably sweep the central conduit over a circular pattern in a field. The center conduit includes a plurality of water sprinkling heads spaced over its length for distributing a spray of water on the circular field area as the center pivot irrigation conduit passes thereby. Center pivot irrigation systems have been successful for uniform distribution of water over a field crop and initially were operated at reasonably high water pressures. Current systems typically work with a somewhat lower water pressure and require that sprinkler heads distribute water evenly as the irrigation conduit moves through a field. A typical patent for a center pivot irrigation system can be seen in the Vikre patent, U.S. Pat. No. 4,356,972, which mounts the sprinkler heads on top of the central irrigation center pivot conduit. The sprinkler head uses a deflector head for deflecting the water with a grooved deflector pad. Other self-propelled mechanically moving irrigation machines can irrigate in a different manner, such as moving laterally in a straight line through a field.

In Applicant's U.S. Pat. No. 5,381,960 teaches a wobbling irrigation sprinkler head and includes a magnet for the initial tilt in the wobbling irrigation sprinkler head for use on a self-propelled mechanical moving irrigation system, such as a center pivot field irrigation system, and has the wobbling sprinkler head facing downward from the water supply conduit.

One of the problems that occurs with sprinkler heads is vibration which can result in wear and premature failure of a sprinkler head. Another problem results when center pivot sprinklers are installed on long drops and get dragged through a variety of crops such as corn, cotton, and sunflowers and as the sprinkler is dragged through the crop, damage can occur to the sprinkler head.

The present invention dampens vibrations and at the same time forms a collar which acts as a shroud to protect the sprinkler head from damage in low ground situations. In addition, the collar acts as a deflector for the water being deflected from a deflector surface to more evenly distribute the water egressing from the sprinkler head. In the present invention, the sprinkler head has been designed to accept a weight on the top thereof with interacting grooves and ribs on the weight and sprinkler head body. The weighted collar is shaped to deflect some of the water from the sprinkler head and dampens vibrations. The weight also acts as a shield to protect the sprinkler head when the sprinkler head is dragged through crops in low clearance situations.

SUMMARY OF THE INVENTION

A sprinkler head especially adapted for use in irrigation systems, such as center pivot irrigation systems, in which a long water conduit is connected at one end to a source of water under pressure. The conduit is carried in an elevated position by wheeled spaced towers which are powered by motors to rotatably move the central conduit over a predetermined pattern. Sprinkler heads are positioned on individual sprinkler head pipes which extend from the top of the central conduit. The sprinkler head has a body attached to a water supply and has a water inlet and a nozzle for directing water therefrom. The sprinkler head body has an upper body portion having a first interlocking member thereon and a lower body portion having a plurality of arms extending therefrom. A water deflecting head is removably attached to the sprinkler head body lower body portion below the plurality of downwardly extending arms to deflect water being emitted from a nozzle thereagainst. A weighted collar has a bore therethrough and has a second interlocking member thereon. The weighted collar has a weight greater than one half pound and is removably attached to the sprinkler head body upper body portion with a second interlocking member engaging the sprinkler upper body interlocking member. The weighted collar has a deflection surface positioned to deflect a portion of the water being deflected by the water deflection head. It also acts to shield the sprinkler head body from damage while adding weight to the sprinkler head for damping vibrations. Interlocking members may include a plurality of grooves which interlock with a plurality of ribs between the weighted collar and the sprinkler head upper body portion.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
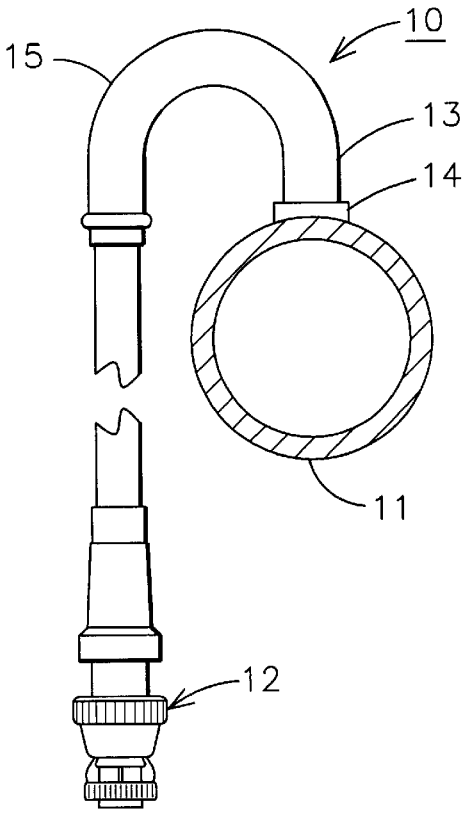
FIG. 1 is a side elevation of a portion of a central irrigation system having the present sprinkler head attached thereto.
Figure 2:
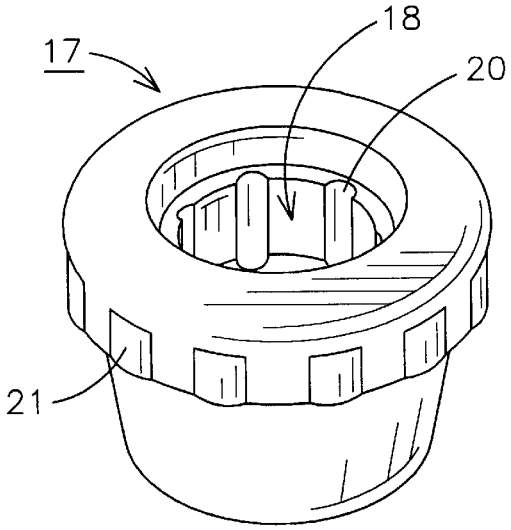
FIG. 2 is a perspective view of a weighted collar for attachment to a sprinkler head of FIG. 1.

Referring to FIG. 1 of the drawings, a portion of a self-propelled mechanical moving irrigation system, such as a center pivot irrigation system 10, has a central irrigation conduit or water supply pipe 11 which is rotated on wheels in a field, such as in a circular pattern for irrigating the field. The central water supply conduit 11 has a plurality of sprinkler heads 12 attached thereto in a spaced relationship to each other. In this case, each sprinkler head pipe 15 extends from the top 13 of the pipe 11 and includes a pipe coupling 14 attached thereto. The pipe 15 has a U-shaped bend and has the sprinkler head 12 attached thereto.

Figure 3:
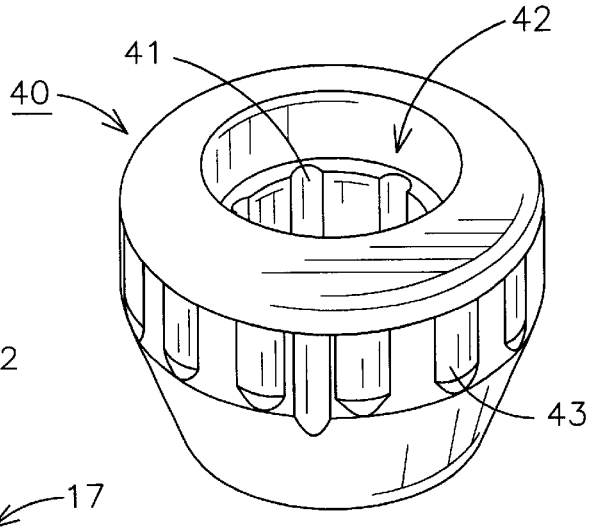
FIG. 3 is a perspective view of an alternative view of a weighted collar for attachment to a sprinkler head of FIG. 1.
Figure 4:
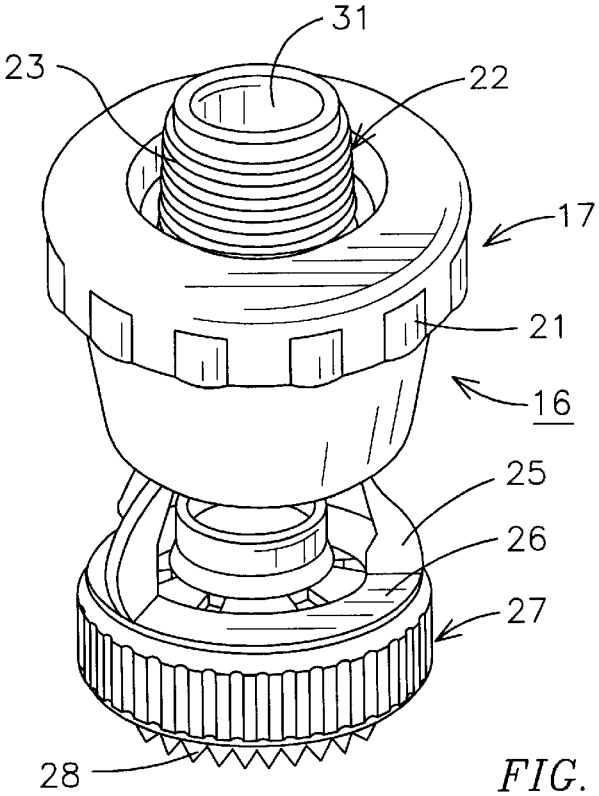
FIG. 4 is a perspective view of a sprinkler head in accordance with the present invention having the weighted collar of FIG. 2 attached thereto.
Figure 5:
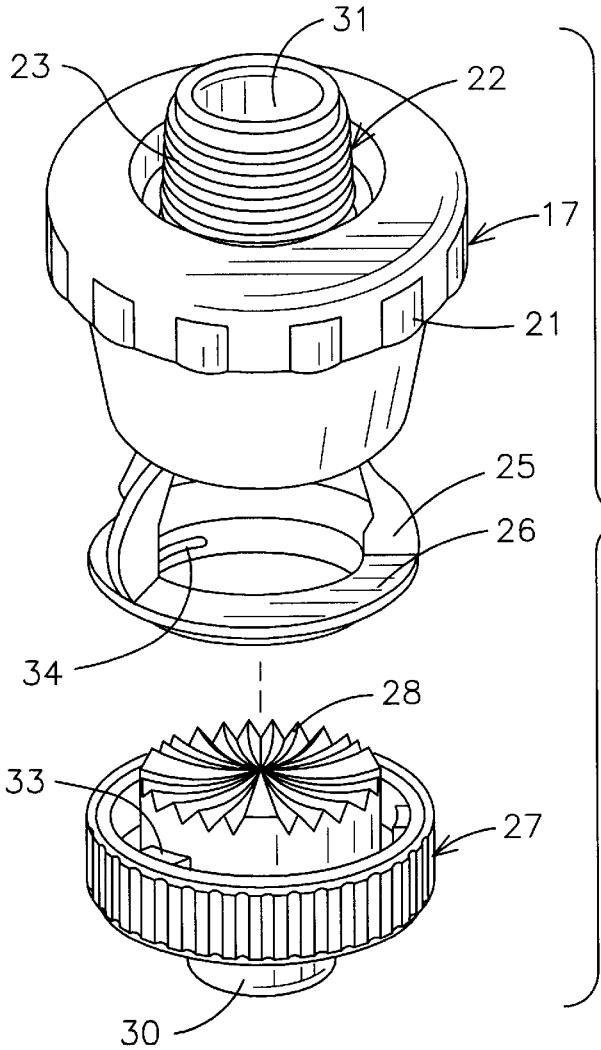
FIG. 5 is an exploded view of the sprinkler head of FIG. 4.
Figure 6:
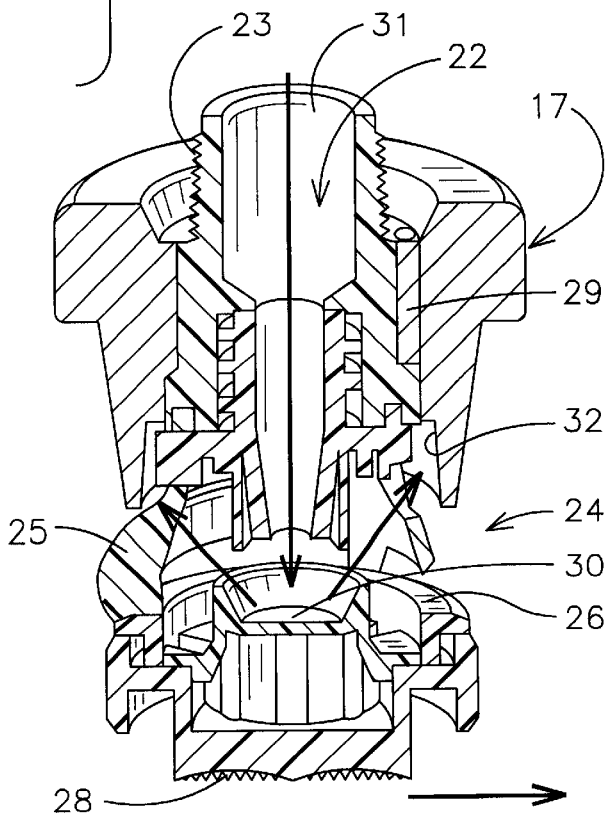
FIG. 6 is a cutaway perspective view of the sprinkler head of FIGS. 4 and 5.

Turning to FIGS. 2–6, a sprinkler head 16 is shown in FIGS. 4, 5 and 6 having a weighted collar 17 supported thereon which weighted collar will typically weigh more than 0.25 pounds and has a bore 18 passing therethrough. Inside the bore of the weighted collar 17 are a plurality of grooves (or threads and/or snap lock) 20 which act as interlocking members or grooves. On the exterior of the collar 17 are a plurality of ribs 21 used for gripping the collar when it is desirable to turn the collar, such as to remove a sprinkler head from its water connection. The sprinkler head has an upper body portion 22 which includes the water connection with threads 23 and a nozzle 24 mounted therein, as seen in FIG. 6. The sprinkler head also has a lower body portion 24 which includes a plurality of downwardly extending arms 25 supporting a base member 26. Attached to the base member 26 is a deflection head 27 which is removably attached to the base member 26 and has a sharply grooved radially extending water deflection members 28 on one side thereof and a deflection cup 30 on the other side thereof. The deflection head 27 can be reversed from one type of sprinkler deflection surface to a second type. In FIG. 5, the deflection head is in one position while in FIGS. 4 and 6, the deflection head is illustrated with the deflection cup 30 deflecting water therefrom. The water is received into the upper body portion through the passageway 31 and through the nozzle 24 and is directed against the deflection surface for cup 30, as seen in FIG. 6. The water is then deflected out of the openings between the arms 25 with part of the water being deflected against the water deflection surface 32 on the inside of the collar 17. The collar acts to deflect the water in a different direction than from that being deflected between the arms to give a better distribution of the water from the sprinkler head 12. The deflection surface 32 is an annular, angled surface shaped to direct the water impinging thereagainst in a predetermined pattern. When the sprinkler head 27 is turned around with the deflection surface grooves 28 facing upwards, the water is deflected in a different pattern based on the serrations in the deflection surface. The deflection head 27 has a plurality of studs 33 formed therein which engages a plurality of grooves 34 in a bayonet locking fashion and allows the deflection head 27 to be mounted in either direction.

FIG. 3 illustrates an alternate embodiment of a weighted collar 40 which has a plurality of interlocking grooves 41 within the internal bore 42 of the collar 40 for engaging the ribs (or threads and/or snap lock) 29 of FIG. 6. It also has a deflection surface on the inside of the collar and external gripping ribs 43 for gripping the collar for an easy rotation of the collar and sprinkler head for removing the sprinkler head from the drop pipe 15. The collar is shaped to be a large collar to add sufficient weight to the top of the sprinkler head and is shaped to protect the sprinkler head in situations where the sprinkler head is dragged through crops in low clearance situations. Thus, the weighted collar acts as a vibration dampener, damping vibrations from the wind and sprinkler action and other sources while at the same time, acting as a shield to shield the sprinkler head against damage when the sprinkler head is dragged through crops being irrigated. The weighted collar also acts as a deflection surface for deflecting water which is being deflected from the sprinkler head nozzle for a better distribution of the water and has an interlocking and gripping surface for easy removal of the sprinkler head from connection to a water source. The sprinkler head weight, advantageously, allows the weighted collar to be added or removed for changing the weighted collar for different weights and shapes.

It should be clear at this time that the present invention illustrates a irrigation sprinkler head which can advantageously be attached upside down or to extend downward from a self-propelled irrigation water line and which is self-draining and produces a stream of water from the nozzle onto the deflection pad and can absorb vibration caused by the wind and sprinkler action and other forces and can be easily customized for different amounts of vibration. The weighted collar deflects water from the sprinkler head and also shields the sprinkler head from physical damage. However, the present invention should not be construed as limited to the forms shown which are to be considered illustrative rather than restrictive.

We claim:

1. A sprinkler head comprising:

a sprinkler head body attachable to a water supply and having a water inlet and a nozzle for directing water from said water inlet, said sprinkler head body having an upper body portion having a first interlocking member thereon and a lower body portion having at least one arm extending therefrom;

a water deflecting head removably attached to said sprinkler head body lower body portion below said at least one extending arm and having a water deflecting surface positioned to deflect water being emitted from said nozzle thereagainst;

a shielding weighted collar having a bore therethrough and having a second interlocking member thereon and being removably attached to said sprinkler head body upper body portion with said second interlocking member engaging said sprinkler upper body first interlocking member, said shielded weighted collar having a deflection surface positioned to deflect a portion of the water being deflected by said water deflection head; whereby a weighted collar reduces vibrations and deflects water from said sprinkler head and shields the sprinkler head from physical damage.

2. A sprinkler head in accordance with claim 1 in which said shielding weighted collar second interlocking member includes a plurality of grooves formed inside the collar bore.

3. A sprinkler head in accordance with claim 2 in which said sprinkler head body upper body portion first interlocking member includes a plurality of ribs formed on the surface thereof.

4. A sprinkler head in accordance with claim 3 in which said shielding weighted collar has a plurality of gripping ribs on the exterior surface thereof.

5. A sprinkler head in accordance with claim 3 in which said shielding weighted collar bore has an annular angled surface therein to deflect water impinging thereon from said sprinkler head.

6. A sprinkler head in accordance with claim 5 in which said water deflecting head has a generally cup shape to deflect water impinging thereon.

7. A sprinkler head in accordance with claim 6 in which said water deflection head has a reverse side removably attachable to said sprinkler head body lower portion.

8. A sprinkler head in accordance with claim 1 in which said weighted collar is greater than 0.25 pounds.

* * * * *